US012029292B1

(12) United States Patent
Hunter et al.

(10) Patent No.: US 12,029,292 B1
(45) Date of Patent: Jul. 9, 2024

(54) CASES FOR ELECTRONIC DEVICES

(71) Applicant: Apple Inc., Cupertino, CA (US)

(72) Inventors: Tirshathah A. Hunter, Oakland, CA (US); Seul Bi Kim, Sunnyvale, CA (US); Nicholas A. Treadwell, Cupertino, CA (US); Johan E. Lyon, San Francisco, CA (US); Erik G. de Jong, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 18/114,912

(22) Filed: Feb. 27, 2023

Related U.S. Application Data

(63) Continuation of application No. 16/988,471, filed on Aug. 7, 2020, now Pat. No. 11,612,226.

(60) Provisional application No. 62/905,945, filed on Sep. 25, 2019.

(51) Int. Cl.

| | |
|---|---|
| ***A45C 11/32*** | (2006.01) |
| ***A45C 11/00*** | (2006.01) |
| ***A45F 5/02*** | (2006.01) |
| *A45C 13/34* | (2006.01) |
| *A45F 5/00* | (2006.01) |

(52) U.S. Cl.
CPC ..... *A45C 11/00* (2013.01); *A45F 5/02* (2013.01); *A45C 2011/002* (2013.01); *A45C 13/34* (2013.01); *A45F 2005/008* (2013.01)

(58) Field of Classification Search
CPC ..... A45C 11/00; A45C 11/323; A45C 13/34; A45C 2011/002; A45F 5/00; A45F 2005/006; A45F 2200/0516
USPC ..... 206/37, 37.1, 38, 38.1, 461–463, 206/775–777, 779–780, 485
See application file for complete search history.

(56) References Cited

U.S. PATENT DOCUMENTS

| | | | | |
|---|---|---|---|---|
| 3,376,975 | A | 4/1968 | Brothers | |
| 4,062,450 | A | 12/1977 | Carter | |
| 4,704,770 | A * | 11/1987 | Minami | G09F 23/00 24/431 |
| 4,907,694 | A * | 3/1990 | Miller | A45C 1/02 206/38.1 |
| 5,407,064 | A | 4/1995 | Huang et al. | |
| 5,467,871 | A * | 11/1995 | DeField | A44B 15/005 206/38.1 |
| 6,594,154 | B1 * | 7/2003 | Brewer | A45C 11/18 361/752 |
| 6,669,017 | B2 * | 12/2003 | Linihan | A44B 15/005 206/37.1 |

(Continued)

*Primary Examiner* — Luan K Bui
(74) *Attorney, Agent, or Firm* — BAKERHOSTETLER

(57) ABSTRACT

A case for a round electronic device may have a device holding portion and an attachment portion for attaching the case to an item such as a suitcase or a key chain. The case may include upper and lower case portions that form a pocket. On a first side of the pocket, the upper and lower case portions may be stitched together or may be integrally formed. On a second side of the pocket, a snap may attach the upper case portion to the lower case portion and may be opened to provide access to the pocket. The attachment portion may have an opening for attaching the case to a key ring, suitcase, or other item. The case may include leather, polymer, and/or fabric. Openings may be surrounded by reinforcement material such as strands of non-elastic material. Snaps may be flush with surrounding portions of the case.

20 Claims, 7 Drawing Sheets

(56) References Cited

U.S. PATENT DOCUMENTS

| | | | | |
|---|---|---|---|---|
| 6,715,315 | B1 * | 4/2004 | Hartgrove | A44C 9/003 63/29.1 |
| 7,405,656 | B2 | 7/2008 | Olsen | |
| 7,604,176 | B2 * | 10/2009 | Bates | A44B 15/005 206/37.1 |
| 7,784,607 | B1 | 8/2010 | Thomas | |
| 9,038,885 | B2 | 5/2015 | Warm | |
| 9,977,926 | B2 | 5/2018 | Huang et al. | |
| 2005/0167288 | A1 | 8/2005 | Sottile | |
| 2006/0038023 | A1 * | 2/2006 | Brewer | G06K 19/005 235/492 |
| 2007/0151872 | A1 * | 7/2007 | Vincent | A45C 11/321 206/38.1 |
| 2014/0135042 | A1 | 5/2014 | Buccheim et al. | |
| 2014/0196539 | A1 | 7/2014 | Martinez et al. | |
| 2014/0206955 | A1 | 7/2014 | Stivoric et al. | |
| 2015/0334524 | A1 | 11/2015 | Fetzer et al. | |

* cited by examiner

CASES FOR ELECTRONIC DEVICES

CROSS-REFERENCE TO RELATED APPLICATION

This application is a continuation of U.S. application Ser. No. 16/988,471, filed Aug. 7, 2020, which claims the benefit of U.S. App. Ser. No. 62/905,945, filed Sep. 25, 2019, which is hereby incorporated by reference herein in its entirety.

FIELD

This relates generally to cases, and, more particularly, to cases for holding electronic devices.

BACKGROUND

Electronic devices such as cellular telephones, computers, and other electronic equipment are sometimes used in conjunction with external cases. A user may, for example, place an electronic device in a removable plastic case to protect the electronic device from scratches.

There are challenges associated with cases for electronic devices. If care is not taken, cases may not wear well, may be bulky, or may have an undesirable appearance.

SUMMARY

A case may be provided for an electronic device such as a round tracking device having a lateral dimension of less than 50 mm or other suitable size and shape. The tracking device may have a battery door and a speaker. The case may be used to couple the tracking device to an item such as a key ring, a suitcase, a collar, or clothing item. An electronic device such as a cellular telephone may be used to track the location of the tracking device and may be used to send control signals to the tracking device.

The case may have a device holding portion for holding the tracking device and an attachment portion for attaching the case to an item such as a suitcase or key chain. The case may be formed from leather, polymer, and/or fabric.

The case may include upper and lower case portions that form the pocket. On a first side of the pocket, the upper and lower case portions may be stitched together or may be integrally formed. On a second side of the pocket, a snap may attach the upper case portion to the lower case portion and may be opened to provide access to the pocket. The snap may be flush with surrounding portions of the case.

The device holding portion may have one or more openings through which the tracking device is exposed. A first opening in the device holding portion may transmit sound from a speaker in the tracking device and a second opening in the device holding portion may receive the battery door. The battery door may be flush with surrounding portions of the case.

The attachment portion may have an opening for attaching the case to a key ring, suitcase, or other item. Openings such as openings in the device holding portion, snap openings for receiving snap structures, and other openings in the case may be surrounded by reinforcement material such as woven strands of non-elastic material.

DETAILED DESCRIPTION

Electronic devices may be provided with cases such as leather cases, plastic cases, and fabric cases. The cases may be removable external cases. When a user desires to protect an electronic device from scratches or other damage, the user may place an electronic device within a case. When the user wishes to use a different case to change the appearance or function of the case, the electronic device may be transferred from one case to another. Cases may also be used to attach an electronic device to an item such as a key chain, bag, clothing, or other item.

Figure 1:
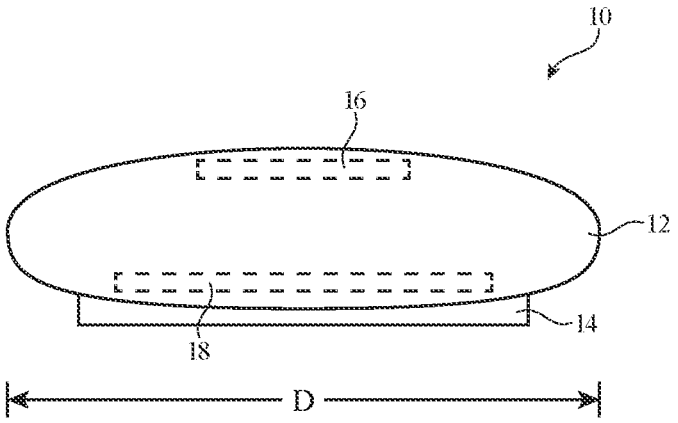
FIG. 1 is a side view of an illustrative electronic device in accordance with an embodiment.

An electronic device of the type that may be provided with a removable case is shown in FIG. 1. Electronic device 10 may be worn or coupled to a person (e.g., a person's wrist, arm, finger, arm, neck, waist, ankle, or other suitable body part), may be worn or coupled to an animal (e.g., cat, dog, etc.), or may be coupled to an object (e.g., a suitcase, key fob, a door knob, an electronic device, or any other suitable object). Electronic device 10 may be configured to communicate with one or more additional electronic devices such as a laptop computer, a computer monitor containing an embedded computer, a tablet computer, a desktop computer, a cellular telephone, a media player, or other handheld or portable electronic device, a smaller device such as a wristwatch device, a pendant device, a headphone or earpiece device, a head-mounted device such as glasses, goggles, a helmet, or other equipment worn on a user's head, or other wearable or miniature device, a television, a computer display that does not contain an embedded computer, a gaming device, a remote control, a navigation device, an embedded system such as a system in which equipment is mounted in a kiosk, in an automobile, airplane, or other vehicle, or equipment that implements the functionality of two or more of these devices.

With one illustrative configuration, which may sometimes be described herein as an example, device 10 is small tracking device coupled to a person, animal, or object using a removable case (e.g., case 20 of FIG. 2) Device 10 may have a circular shape, a round shape, an oval shape, a rectangular shape, and/or other suitable shape. Device 10 may have a lateral dimension D between 25 mm and 50 mm, between 50 mm and 100 mm, between 10 mm and 200 mm, between 5 mm and 75 mm, less than 50 mm, or greater than 50 mm.

Device 10 may communicate with one or more electronic devices such as cellular telephone, tablet computer, laptop computer, wristwatch device, head-mounted device, a device with a speaker, or other electronic device (e.g., a device with a display, audio components, and/or other output components). The one or more electronic devices that communicate with device 10 may sometimes be referred to as host devices. The host devices may run software that is used to track the location of device 10, send control signals to device 10, receive data from device 10, and/or perform other functions related to the operation of device 10.

In the example of FIG. 1, device 10 includes a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Device 10 may include one or more energy storage devices 18. Energy storage devices 18 may include batteries and capacitors. Capacitors for energy storage may be based on supercapacitor structures. Devices 18 may, for example, include super capacitor(s) such as electrostatic double-layer capacitors. Electrostatic double-layer capacitors (sometimes referred to as electrostatic double-layer supercapacitors) are electrochemical capacitors in which energy is stored in a capacitor formed from relatively large electrodes that are bathed in electrolyte and separated by a small distance, allowing the capacitor to achieve high energy storage capacities.

Energy storage device 18 may be charged via a wired connection or, if desired, device 10 may charge energy storage device 18 using wirelessly received power (e.g., inductive wireless power transfer, using capacitive wireless power transfer, and/or other wireless power transfer configurations). In some arrangements, which may sometimes be described herein as an example, energy storage device 18 is a removable battery that can be replaced. Housing 12 may include a door such as battery door 14 through which energy storage device 18 may be accessed. When it is desired to replace energy storage device 18 with a new battery, a user or other individual may open door 14, remove battery 18, place a new battery in housing 12, and close door 14. This is, however, merely illustrative. If desired, energy storage device 18 may be charged wirelessly or via a wired connection.

Device 10 may include electrical components 16 mounted in housing 12. Electrical components 16 may include integrated circuits, discrete components, light-emitting components, sensors, and/or other circuits and may, if desired, be interconnected using signal paths in one or more printed circuits. If desired, one or more portions of the housing walls may be transparent to light and/or sound (e.g., so that light associated with an image on a display or other light-emitting or light-detecting component can exit housing 12, so that sound from a speaker in device 10 can exit housing 12, etc.).

Electrical components 16 may include control circuitry. The control circuitry may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in the control circuitry may be used to control the operation of device 10. For example, the processing circuitry may use sensors and other input-output circuitry to gather input and to provide output and/or to transmit signals to external equipment. The processing circuitry may be based on one or more microprocessors, microcontrollers, digital signal processors, baseband processors, power management units, audio chips, application specific integrated circuits, etc. The control circuitry may include wired and/or wireless communications circuitry (e.g., antennas and associated radio-frequency transceiver circuitry such as cellular telephone communications circuitry, wireless local area network communications circuitry, etc.). The communications circuitry of the control circuitry may allow device 10 to communicate with other electronic devices. For example, the control circuitry (e.g., communications circuitry in the control circuitry) may be used to allow wired and/or wireless control commands and other communications to be conveyed between devices such as cellular telephones, tablet computers, laptop computers, desktop computers, head-mounted devices, handheld controllers, wristwatch devices, other wearable devices, keyboards, computer mice, remote controls, speakers, accessory displays, accessory cameras, and/or other electronic devices. Wireless communications circuitry may, for example, wirelessly transmit control signals and other information to external equipment in response to receiving user input or other input from sensors or other devices in components 16.

Input-output circuitry in components 16 of device 10 may be used to allow data to be supplied to device 10 and to allow data to be provided from device 10 to external devices. The input-output circuitry may include input devices that gather user input and other input and may include output devices that supply visual output, audible output, or other output.

Output may be provided using light-emitting diodes (e.g., crystalline semiconductor light-emitting diodes for status indicators and/or displays, organic light-emitting diodes in displays and other components), lasers, and other light-emitting devices, audio output devices (e.g., tone generators and/or speakers), haptic output devices (e.g., vibrators, electromagnetic actuators, piezoelectric actuators, and/or other equipment that supplies a user with haptic output), and other output devices.

The input-output circuitry of device 10 (e.g., the input-output circuitry of components 16) may include sensors. Sensors for device 10 may include force sensors (e.g., strain gauges, capacitive force sensors, resistive force sensors, etc.), audio sensors such as microphones, touch and/or proximity sensors such as capacitive sensors (e.g., a two-dimensional capacitive touch sensor integrated into a display, a two-dimensional capacitive touch sensor and/or a two-dimensional force sensor overlapping a display, and/or a touch sensor or force sensor that forms a button, trackpad, or other input device not associated with a display), and other sensors. Touch sensors for a display or for other touch components may be based on an array of capacitive touch sensor electrodes, acoustic touch sensor structures, resistive touch components, force-based touch sensor structures, a light-based touch sensor, or other suitable touch sensor arrangements. If desired, a display may have a force sensor for gathering force input (e.g., a two-dimensional force sensor may be used in gathering force input on a display). If desired, device 10 may not include a display.

If desired, the sensors may include optical sensors such as optical sensors that emit and detect light, ultrasonic sensors, optical touch sensors, optical proximity sensors, and/or other touch sensors and/or proximity sensors, monochromatic and color ambient light sensors, image sensors, fingerprint sensors, temperature sensors, sensors for measuring three-dimensional non-contact gestures ("air gestures"), pressure sensors, sensors for detecting position, orientation, and/or motion (e.g., accelerometers, magnetic sensors such as compass sensors, gyroscopes, and/or inertial measurement units that contain some or all of these sensors), health sensors, radio-frequency sensors (e.g., sensors that gather position information, three-dimensional radio-frequency images, and/or other information using radar principals or other radio-frequency sensing), depth sensors (e.g., structured light sensors and/or depth sensors based on stereo imaging devices), optical sensors such as self-mixing sensors and light detection and ranging (lidar) sensors that gather time-of-flight measurements, humidity sensors, moisture sensors, gaze tracking sensors, three-dimensional sensors (e.g., time-of-flight image sensors, pairs of two-dimensional image sensors that gather three-dimensional images using binocular vision, three-dimensional structured light sensors that emit an array of infrared light beams or other structured light using arrays of lasers or other light emitters and associated optical components and that capture images of the spots created as the beams illuminate target objects, and/or other three-dimensional image sensors), facial recognition sensors based on three-dimensional image sensors, and/or other sensors.

In some configurations, components 16 may include mechanical devices for gathering input (e.g., buttons, joysticks, scrolling wheels, key pads with movable keys, keyboards with movable keys, and other devices for gathering user input). During operation, device 10 may use sensors and/or other input-output devices in components 16 to gather user input (e.g., buttons may be used to gather button press input, touch and/or force sensors overlapping displays can be used for gathering user touch screen input and/or force input, touch pads and/or force sensors may be used in gathering touch and/or force input, microphones may be used for gathering audio input, etc.). The control circuitry of device 10 can then take action based on this gathered information (e.g., by transmitting the information over a wired or wireless path to external equipment, by supplying a user with output using a haptic output device, visual output device, an audio component, or other input-output device in housing 12, etc.).

In one illustrative arrangement, which is sometimes described herein as an example, component 16 is a speaker that emits sound through housing 12 (e.g., through perforations in housing 12 or other sound-transparent regions of housing 12). A speaker in device 10 may, for example, emit sound to help guide a user to the location of device 10 (and thus the location of the object, animal, or person that device 10 is coupled to).

Figure 2:
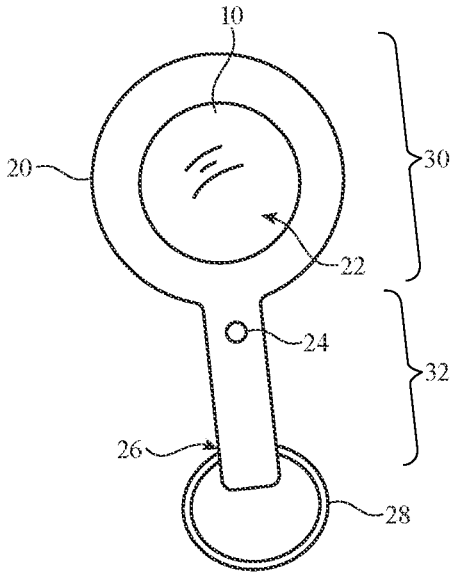
FIG. 2 is a perspective view of an illustrative electronic device that has been inserted into a case with a key ring in accordance with an embodiment.

FIG. 2 is a perspective view of device 10 of FIG. 1 in a configuration in which device 10 has been mounted in a removable case such as case 20. Case 20 may be formed from leather and/or artificial leather, may be formed from polymer (e.g., polyurethane and/or other suitable polymer), may be formed from elastomeric polymer (e.g., silicone and/or other stretchable plastics), may be formed from fabric (e.g., intertwined strands of material that form woven fabric, knit fabric, warp knit fabric, braided fabric, and/or other suitable fabric), may be formed from metal (e.g., metal links, interlinked chain links, etc.), may be formed from other materials (e.g., wood and/or other natural materials, ceramic, crystalline materials, etc.), and/or may be formed from a combination of these materials. Configurations in which case 20 is formed from leather, fabric, and/or polymer materials may sometimes be described herein as an example. Arrangements in which case 20 includes waterproof materials, water-resistant materials, and/or oil-resistant materials may also be used.

Case 20 may have a device holding portion such as portion 30 and an attachment portion such as portion 32. Device holding portion 30 may be configured to hold and retain device 10. As shown in FIG. 2, device holding portion 30 may have walls that run around the periphery of device 10. Case 20 may have one or more pockets, flaps, hinged portions, straps, and/or other structures for retaining, protecting, and/or otherwise holding or enclosing device 10.

In one illustrative arrangement, which is sometimes described herein as an example, device holding portion 30 may form a pocket that receives device 10. The pocket may be opened and closed using an attachment mechanism such as attachment structure 24. Attachment structure 24 may be a snap, a twist closure, a screw closure, a flexible closure, a magnetic closure, or other suitable closure. A user may open and close attachment structure 24 when it is desired to remove device 10 from case 20 and/or insert device 10 into case 20.

In the example of FIG. 2, case 20 surrounds an outer periphery of device 10, but does not cover all of device 10. In particular, case 20 may have one or more openings such as opening 22. Openings in case 20 such as opening 22 may receive portions of device 10, may transmit sound from a speaker, and/or may serve other functions. Openings 22 may be filled with air, with portions of device 10, with sound-transmitting material, with radio-transparent material, with light-transmitting material, and/or other suitable materials. If desired, openings 22 may have smaller dimensions than device 10 so that device 10 does not fall out of openings 22.

In one illustrative arrangement, which is sometimes described herein as an example, case 20 has a first opening 22 on a first side of case 20 for receiving battery door 14 of device 10 and a second opening 22 on a second opposing side of case 20 that transmits sound from a speaker (e.g., speaker or other electrical component 16 of FIG. 1) in device 10. This is merely illustrative. if desired, some or all of openings 22 may be omitted such that device 10 is completely covered or nearly covered with case 20.

Attachment portion 32 may be used to attach case 20 to an object, person, animal, or other item. In the illustrative arrangement of FIG. 2, attachment portion 32 includes an opening such as opening 26 for receiving a key ring such as key ring 28. Key ring 28 may be coupled to another key ring (e.g., a key chain), a belt loop, a leash, a collar, or other suitable item.

The use of a key ring to attach case 20 to an item is merely illustrative. If desired, case 20 may have attachment portions 32 with other suitable attachment features for attaching case 20 to an item. For example, as shown in the illustrative configuration of FIG. 4, attachment portion 32 may be an elongated strip of material that loops through itself. In particular, attachment portion 32 may have an opening such as opening 34 through which device holding portion 30 may be inserted and pulled through so that attachment portion 32 forms a loop. When it is desired to attach case 20 to an item (e.g., a suitcase), attachment portion 32 may be looped around the item and device holding portion 30 may be inserted through opening 34 to enclose the item (or a portion of the item such as a luggage tag portion of a suitcase) in the loop formed by attachment portion 32. Opening 34 may have a widened portion such as portion 34P that keeps attachment portion 32 in place when it is looped around an item.

Figure 3:
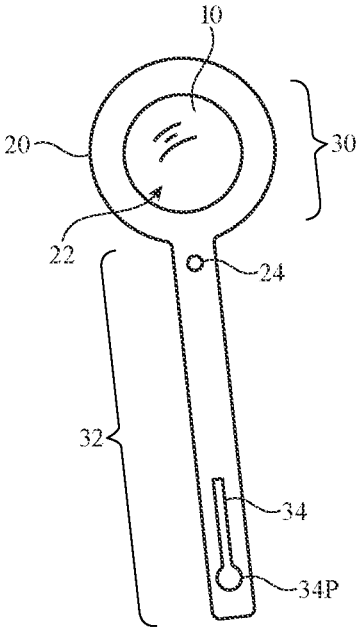
FIG. 3 is a perspective view of an illustrative electronic device that has been inserted into a case having an elongated attachment portion with an opening in accordance with an embodiment.
Figure 4:
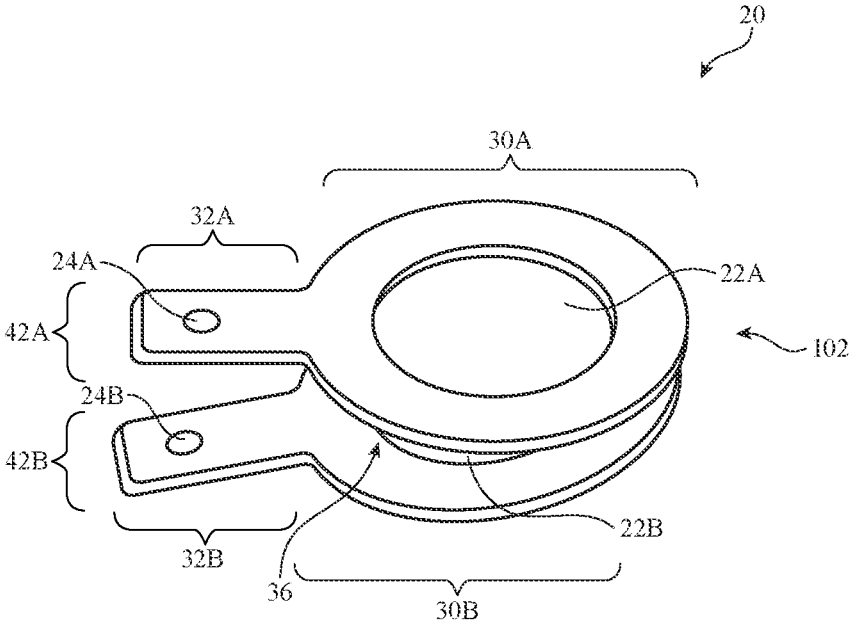
FIG. 4 is a perspective view of an illustrative case having a device holding portion and an attachment portion in accordance with an embodiment.

FIG. 4 is a perspective view of case 20 (e.g., a case of the type shown in FIG. 2, a case of the type shown in FIG. 3, or other suitable case). As shown in FIG. 4, case 20 may have portions such as upper portion 42A and lower portion 42B. Upper and lower portions 42A and 42B of case 20 may surround a cavity such as pocket 36 for receiving device 10. Upper and lower portions 42A and 42B may be separate structures that are permanently attached to each other (e.g., using stitching, adhesive, or other attachment structures), may be separate structures that are removably attached to each other (e.g., using snaps, magnetic structures, clasps, clips, and/or other attachment structures), and/or may be integrally formed with one another (e.g., may share one or more common layers of material). In one illustrative arrangement, which may sometimes be described herein as an example, upper and lower portions 42A and 42B are removably coupled on one side (e.g., via mating attachment structures 24A and 24B) and permanently coupled on an opposing side (e.g., via stitching in region 102 and/or by being integrally formed in region 102). Other configurations may be used, if desired.

As shown in FIG. 4, upper portion 42A of case 20 may have a device holding portion 30A and an attachment portion 32A. Lower portion 42B of case 20 may have a device holding portion 30B and an attachment portion 32B. Device holding portions 30A and 30B may have respective openings 22A and 22B. Opening 22A may receive battery door 14 of device 10 and opening 22B may transmit sound from a speaker (e.g., component 16 of FIG. 1) in device 10, or opening 22A may transmit sound from a speaker in device 10 and opening 22B may receive battery door 14 of device 10. This is, however, merely illustrative. If desired, one or both of openings 22A and 22B may be omitted, may be replaced with an array of perforations (e.g., instead of a single opening), and/or may overlap other portions of device 10.

Attachment portion 32A may have an attachment feature such as snap structure 24A that mates with a corresponding attachment feature in attachment portion 32B such as snap structure 24B. When device 10 is in pocket 36 and snap structures 24A and 24B are engaged, device 10 may be securely held within case 20. When it is desired to remove device 10 from case 20, snap structures 24A and 24B may be disengaged and portion 42A may be moved apart from portion 42B, thereby allowing access to device 10 in pocket 36.

Figure 5:
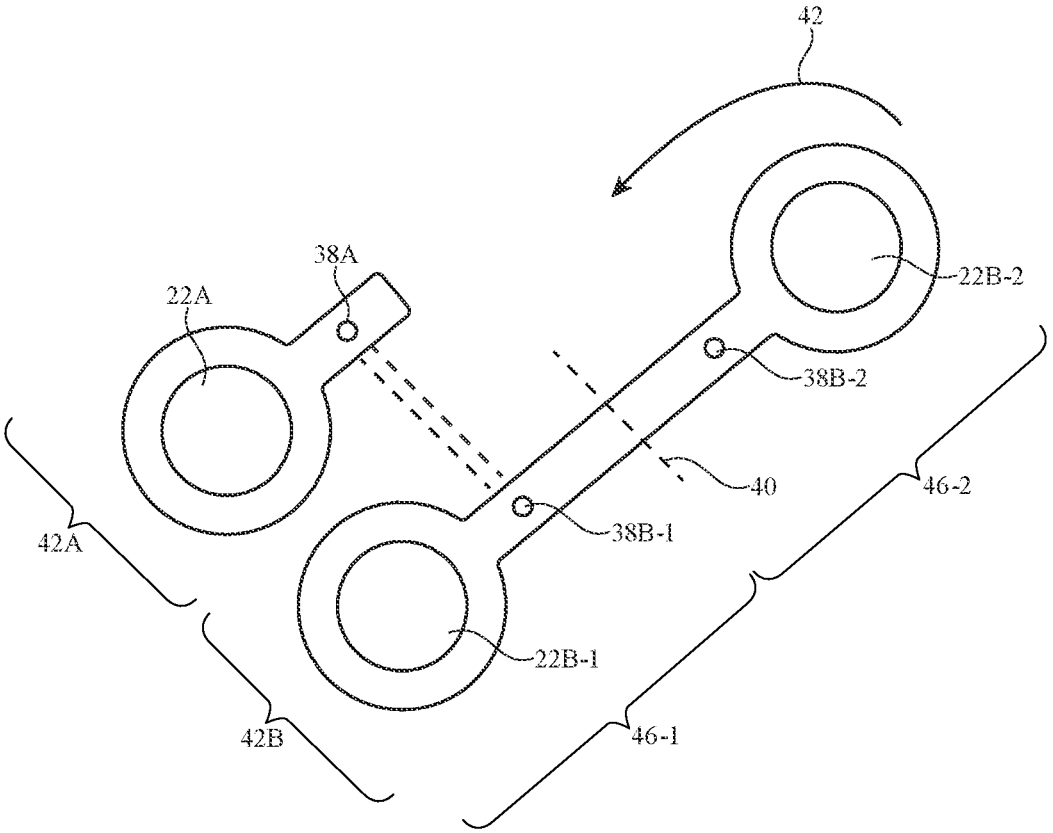
FIG. 5 is a diagram showing how an illustrative case may have an upper portion that mates with a folded lower portion in accordance with an embodiment.
Figure 6:
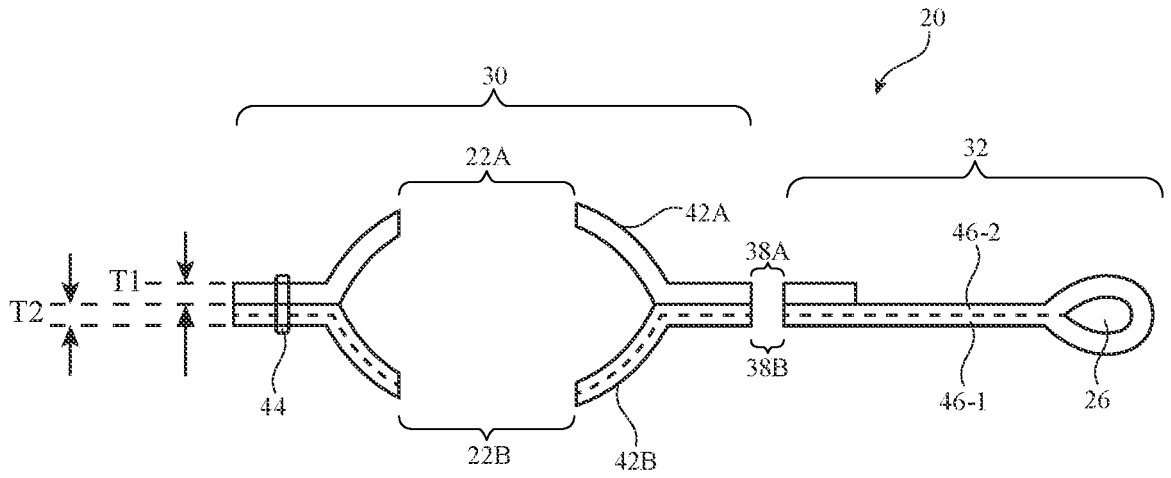
FIG. 6 is a side view of an illustrative case of the type shown in FIG. 5 having an upper portion that is attached to a folded lower portion in accordance with an embodiment.
Figure 7:
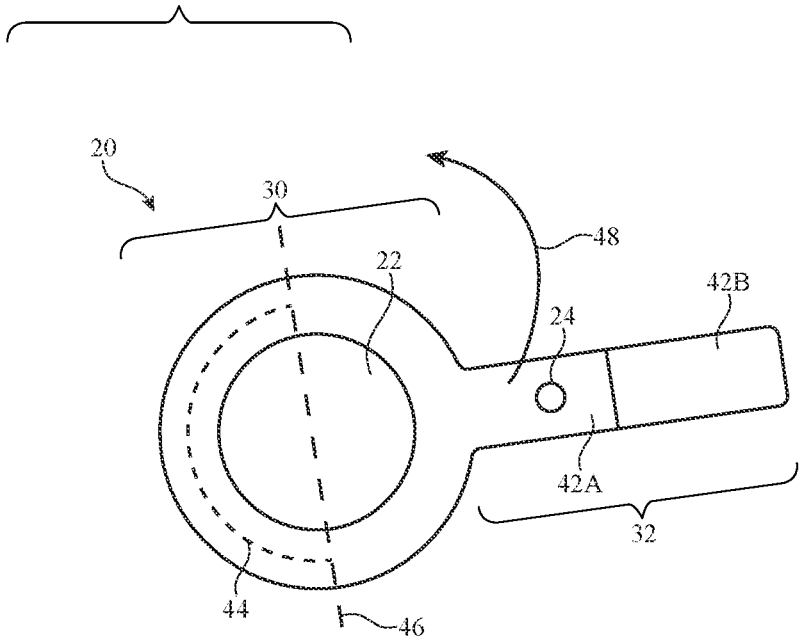
FIG. 7 is a top view of an illustrative case of the type shown in FIG. 5 having an upper portion that is stitched to a lower portion in accordance with an embodiment.

FIGS. 5, 6, and 7 show an illustrative arrangement in which upper and lower portions of case 20 are formed as separate structures that are coupled together to form case 20.

FIG. 5 shows an exploded perspective view of case 20 before upper portion 42A is attached to lower portion 42B. In order to form a key ring opening in case 20 (e.g., key ring opening 26 of FIG. 2), lower portion 42B may be formed from layers of material that are folded. In particular, lower portion 42B may be folded along fold axis 40 to create a loop near fold axis 40. This loop near fold axis 40 may be used to form opening 26 at the end of attachment portion 32 (FIG. 2).

Since lower portion 42B is folded over on itself, lower portion 42B may have symmetric halves such as first portion 46-1 and second portion 46-2 on opposing sides of fold axis 40. Some or all of the features in first portion 46-1 may mirror the features in second portion 46-2 so that corresponding features align with one another after lower portion 42B is folded. Portion 46-1 may have opening 22B-1 and snap opening 38B-1. Portion 46-2 may have opening 22B-2 and snap opening 38B-2. After lower portion 42B is folded along fold axis 40 (e.g. by moving portion 46-2 towards portion 46-1 in direction 42), opening 22B-1 may align with opening 22B-2 (to form opening 22B of FIG. 4) and snap opening 38B-1 may align with snap opening 38B-2 (e.g., to form an opening for receiving lower snap structure 24B of FIG. 4).

Once folded and appropriately aligned, portions 46-1 and 46-2 may be adhesively bonded together, stitched together, or otherwise attached to one another except in the region around fold axis 40 that forms opening 26. Upper portion 42A may then be aligned with lower portion 42B (e.g., by aligning opening 22A with openings 22B-1 and 22B-2, aligning opening 38A with openings 38B-1 and 38B-2, etc.) and attached to lower portion 42B with adhesive, stitching, or other suitable attachment structures.

FIG. 6 is a cross-sectional side view of case 20 of FIG. 5 after lower portion 42B is folded and attached to upper portion 42A. As shown in FIG. 6, lower portion 42B has portion 46-2 which is folded on top of portion 46-1. Portions 46-1 and 46-2 may be attached to one another except in a region near the fold axis. Near the folded axis, portions 46-1 and 46-2 may be separated by a gap that forms opening 26 in attachment portion 32 of case 20.

Upper portion 42A may be attached to lower portion 42B using attachment structure 44. Attachment structure 44 may be stitching, adhesive, and/or other suitable attachment structure. After upper portion 42A is attached to lower portion 42B, opening 22A aligns with opening 22B (which is formed by openings 22B-1 and 22B-2 of FIG. 5). Snap opening 38A aligns with snap opening 38B (which is formed by openings 38B-1 and 38B-2 of FIG. 5). Snap opening 38A may be configured to receive upper snap structure 24A of FIG. 4 and snap opening 38B may be configured to receive lower snap structure 24B of FIG. 4.

In some arrangements, it may be desirable to have the thickness T1 of upper portion 42A match the thickness T2 of lower portion 42B. Since lower portion 42B is folded over on itself, portions 46-1 and 46-2 of lower portion 42B may each have a thickness that is half the thickness T1 of upper portion 42A. This way, when lower portion 42B is folded over on itself, the combined thickness of portions 46-1 and 46-2 (e.g., thickness T2) will be equal to the thickness T1 of upper portion 42A. If desired, portions 46-1 and 46-2 of lower portion 42B may each have half the number of layers that are located in upper portion 42A to achieve equal thicknesses once lower portion 42B is folded. This is, however, merely illustrative. If desired, thickness T1 may be greater than, equal to, or less than thickness T2.

FIG. 7 shows a top view of case 20 of FIG. 6. As shown in FIG. 7, upper portion 42A may be attached to lower portion 42B using attachment structure 44 (e.g., stitching, adhesive, etc.). Attachment structure 44 may extend only partially around the perimeter of device holding portion 30 so that upper portion 42A can be separated from lower portion 42B when it is desired to remove device 10 from pocket 36 or to insert device 10 into pocket 36 of case 20. Snap 24 may be used to secure upper portion 42A to lower portion 42B at the open end of the pocket. When it is desired to remove or insert device 10, snap 24 may be disengaged, thereby allowing upper portion 42A to open away from lower portion 42B in direction 48. Upper portion 42A and/or or lower portion 42B may be configured to hinge along axis 46 as upper portion 42A moves away from lower portion 42B. After device 10 is inserted, snap 24 may be engaged to secure device 10 in the pocket formed between upper and lower portions 42A and 42B.

Figure 8:
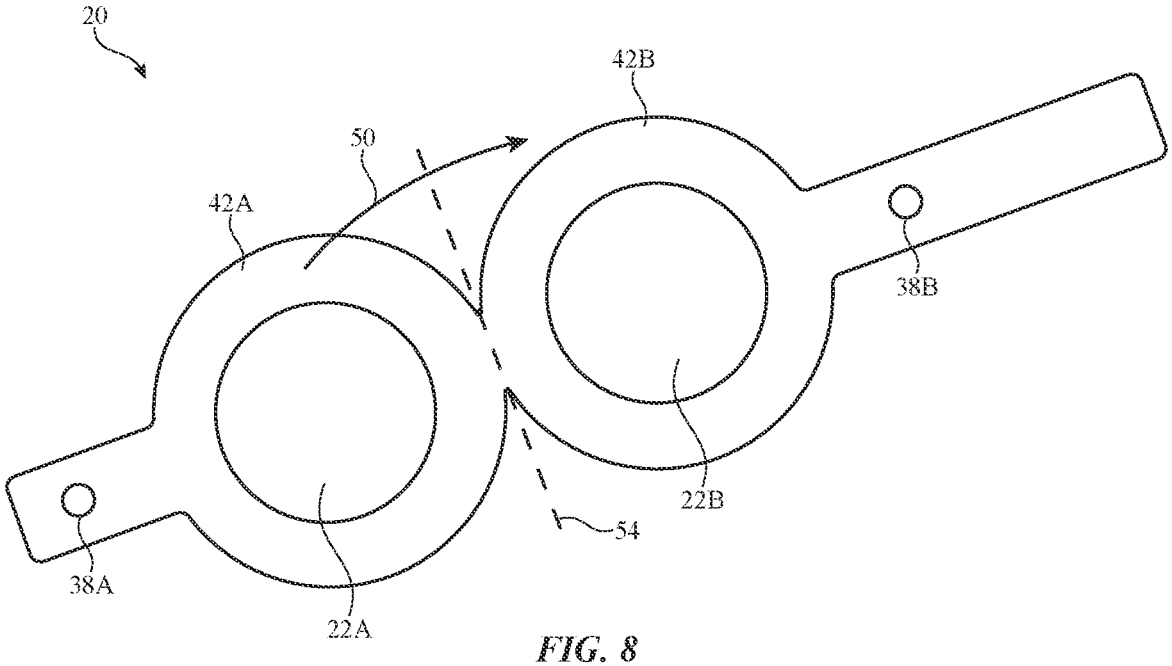
FIG. 8 is a top view of an illustrative case that is formed by folding an upper portion relative to a lower portion in accordance with an embodiment.
Figure 9:
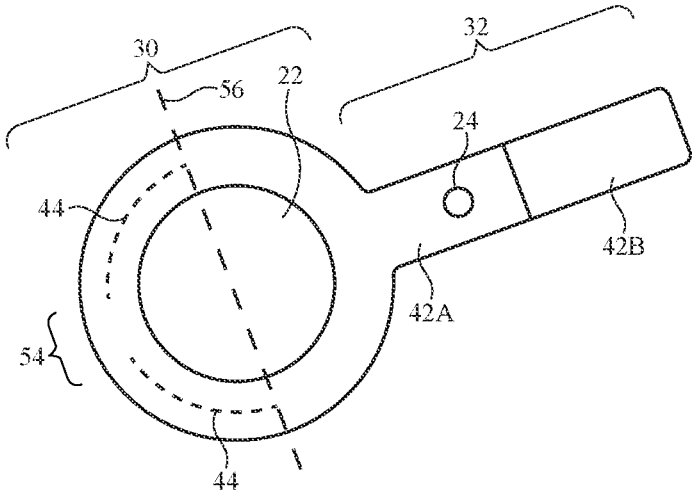
FIG. 9 is a top view of an illustrative case of the type shown in FIG. 8 having an upper portion that is stitched to a lower portion in accordance with an embodiment.

FIGS. 8 and 9 show an illustrative arrangement in which upper portion 42A and lower portion 42B are integrally formed from one or more common layers of material. As shown in FIG. 8, upper portion 42A and lower portion 42B may be formed from one or more layers of material that are folded along line 54 (e.g., by moving upper portion 42A in direction 50 towards lower portion 42B). Upper portion 42A may have features that mirror the features of lower portion 42B so that the corresponding features align when the two portions are folded on top of one another. For example, upper portion 42A may have opening 22A and snap opening 38A that respectively align with opening 22B and snap opening 38B after upper portion 42A is folded on top of lower portion 42B.

FIG. 9 is a top view of case 20 of FIG. 8 after upper portion 42A has been folded on top of lower portion 42B. As shown in FIG. 9, attachment structure 44 (e.g., stitching, adhesive, etc.) may be used to secure portions of portion 42A to portion 42B around the periphery of device holding portion 30. Attachment structure 44 may extend only partially around the periphery of device holding portion 30 so that upper portion 42A can be separated from lower portion 42B when it is desired to remove device 10 from pocket 36 or to insert device 10 into pocket 36 of case 20. Snap 24 may be used to secure upper portion 42A to lower portion 42B at the open end of pocket 36. When it is desired to remove or insert device 10, snap 24 may be disengaged, thereby allowing upper portion 42A to open away from lower portion 42B in direction 48. Upper portion 42A and/or or lower portion 42B may be configured to hinge along axis 56 as upper portion 42A moves away from lower portion 42B. After device 10 is inserted, snap 24 may be engaged to secure device 10 in the pocket formed between upper and lower portions 42A and 42B.

Figure 10:
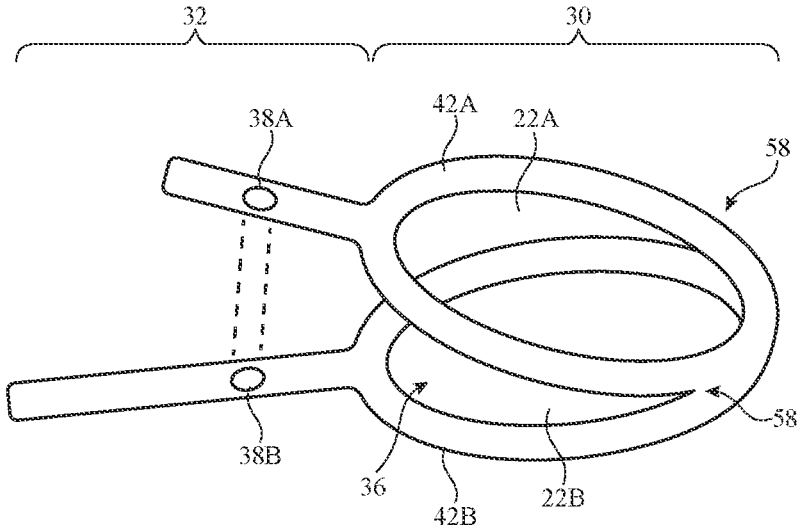
FIG. 10 is a perspective view of an illustrative case having an upper portion integrally formed with a lower portion in accordance with an embodiment.
Figure 11:
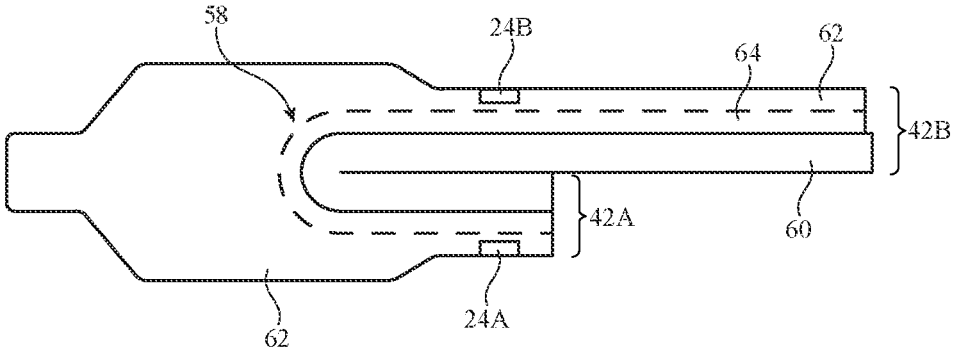
FIG. 11 is a cross-sectional side view of an illustrative case of the type shown in FIG. having multiple layers in accordance with an embodiment.

FIGS. 10 and 11 show another illustrative arrangement in which upper portion 42A and lower portion 42B are integrally formed from one or more common layers of material. As shown in FIG. 10, case 20 may be formed from one or more layers of material (e.g., one or more layers of polymer such as polyurethane or other suitable polymer) that are molded to form the shape of upper and lower portions 42A and 42B. Upper portion 42A may have features that mirror the features of lower portion 42B so that the corresponding features align when case 20 is closed. For example, upper portion 42A may have opening 22A and snap opening 38A that respectively align with opening 22B and snap opening 38B when case 20 is closed.

As shown in FIG. 10, upper and lower case portions 42A and 42B may be integrally formed on one side of pocket 36 and may be separated from one another on the opposing side of pocket 36. Joint regions 58 may be located in regions of case 20 where upper portion 42A separates from lower portion 42B. In the example of FIG. 10, case 20 has first and second joint regions 58 at first and second locations around device holding portion 30. Between the two joint regions 58, upper portion 42A may be integral with lower portion 42B. The remainder of upper portion 42A and 42B may be free to move relative to one another as case 20 is opened and closed.

FIG. 11 is a cross-sectional view of case 20 of FIG. 10 in the vicinity of joint region 58. As shown in FIG. 11, case 20 may include multiple layers of material such as inner molded polymer layer 60, outer molded polymer layer 62, and filler layer 64 (e.g., foam, fabric, additional polymer, adhesive, and/or other suitable materials). Filler layer 64 may be interposed between inner molded polymer layer 60 and outer molded polymer layer 62. Inner polymer layer 60 may have an upper portion that forms part of upper portion 42A (and that forms an upper portion of pocket 36 of FIG. 10) and a lower portion that forms part of lower portion 42A (and that forms a lower portion of pocket 36 of FIG. 10). Inner polymer layer 60 may, if desired, be molded with a U-shape as shown in FIG. 11. By molding inner polymer layer 60 into the shape of upper and lower portions 42A and 42B, joint regions 58 may be more robust and tear-resistant because joint regions 58 are formed from a continuous layer of polymer that spans from upper region 42A to lower region 42B.

Outer polymer layer 62 have an upper portion that overlaps inner polymer layer 60 and that forms part of upper portion 42A and a lower portion that overlaps inner polymer layer 60 and that forms part of lower portion 42B. Outer polymer layer 62 may also be molded into a U-shape as shown in FIG. 11, if desired. This is merely illustrative, however. If desired, upper portion 42A and lower portion 42B may be formed from separate polymer layers that are joined together at joint regions 58 using adhesive, stitching, or other attachment structures.

Figure 12:
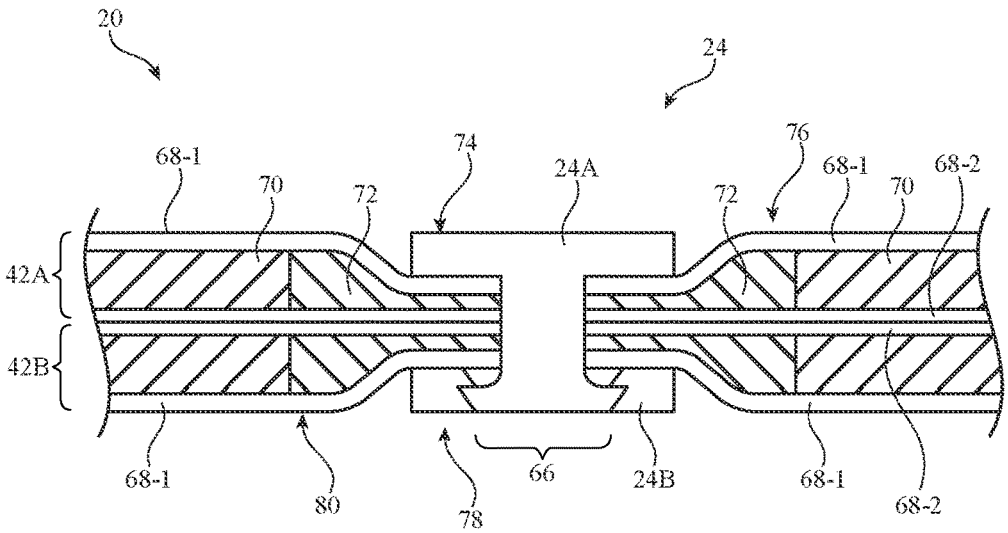
FIG. 12 is a cross-sectional side view of an illustrative case having a snap surrounded by a reinforcement material in accordance with an embodiment.

FIG. 12 is a cross-sectional side view of case 20 in the vicinity of snap 24. As shown in FIG. 12, snap 24 may include upper snap structure 24A and lower snap structure 24B. Upper snap structure 24A may be located in opening 38A of upper portion 42A, and lower snap structure 24B may be located in opening 38B of lower portion 42B.

As shown in FIG. 12, the outer surfaces of snap 24 may be flush with the surrounding outer surfaces of case 20. For example, upper surface 74 of snap structure 24A may be flush with the upper surface 76 of upper portion 42A, and lower surface 78 of snap structure 24B may be flush with lower surface 80 of lower portion 42B. This creates smooth outer surfaces of case 20 and also avoids a bulge in case 20 where snap 24 is located. These flush surfaces may be created by reducing the thickness of upper portion 42A and lower portion 42B around the vicinity of snap 24 to accommodate snap 24. Upper snap structure 24A may engage with lower snap structure 24B. Lower snap structure 24B may have an opening such as opening 66 through which upper snap structure 24A may be inserted. When upper snap structure 24A is fully engaged with lower snap structure 24B, the surface of upper snap structure 24A may be exposed through opening 66 (e.g., may not be covered by a cap) and may be flush with lower surface 78 of lower snap structure 24B, if desired. This also helps maintain a slim profile without bulges around snap 24.

Upper portion 42A and lower portion 42B may each have multiple layers of material such as outer layers 68-1 and inner layers 68-2 (e.g., leather layers, fabric layers, polymer layers, etc.). A filler material such as filler material 70 may interposed between outer layers 68-1 and inner layers 68-2.

Filler material 70 may be a composite layer of thermoplastic polyurethane and adhesive and/or may include other materials.

Case 20 may have reinforcement material such as reinforcement material 72 that helps reinforce openings in case 20 such openings for snap 24 (e.g., openings 38A and 38B of FIGS. 5, 6, 8, and 10), openings 22A and 22B in device holding portion 30, and/or other openings in case 20 such as opening 34. Reinforcement material 72 may be formed from one or more strands of non-elastic material such as Vectran yarn (e.g., woven Vectran) or other suitable material that allows case 20 to flex without changing size (if desired). In the example of FIG. 12, reinforcement material 72 surrounds snap 24.

Figure 13:
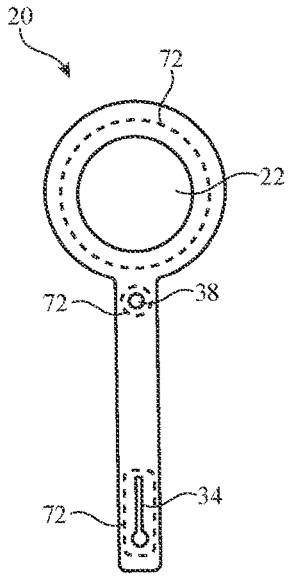
FIGS. 13, 14, and 15 are top views of an illustrative case having reinforcement material incorporated in different patterns around openings in the case in accordance with embodiments.
Figure 14:
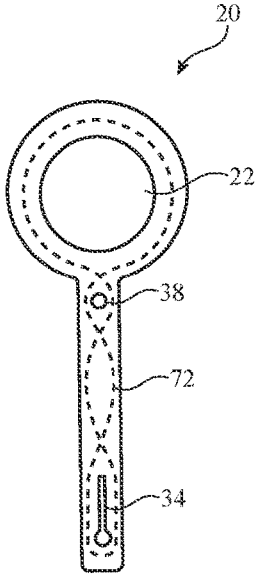
Figure 15:
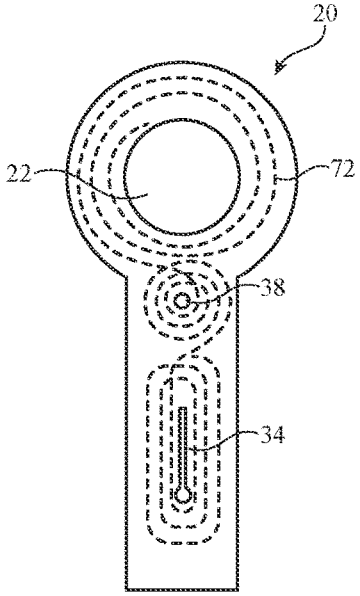

FIGS. 13, 14, and 15 show top views of case 20 with different patterns of reinforcement material 72 (e.g., a yarn or other strand of material having a relatively high modulus of elasticity).

In the example of FIG. 13, reinforcement material 72 has separate portions surrounding each opening in case 20 such as opening 22, snap opening 38, and opening 34. If desired, reinforcement material 72 may surround the entire perimeter of opening 22, may surround the entire perimeter of snap opening 38, and/or may surround the entire perimeter of opening 34.

In the example of FIG. 14, reinforcement material 72 has one or more strands that loop around openings 22, 38, and 34 and that span continuously between openings 22, 38, and 38. Incorporating strands of reinforcement material 72 that span between openings in case 20 may help increase the robustness of case 20 and may help prevent breakage and tearing.

FIG. 15 shows an example in which reinforcement material 72 makes multiple loops around openings 22, 38, and 34 and spans continuously between openings 22, 38, and 38 to increase the robustness of case 20.

Figure 16:
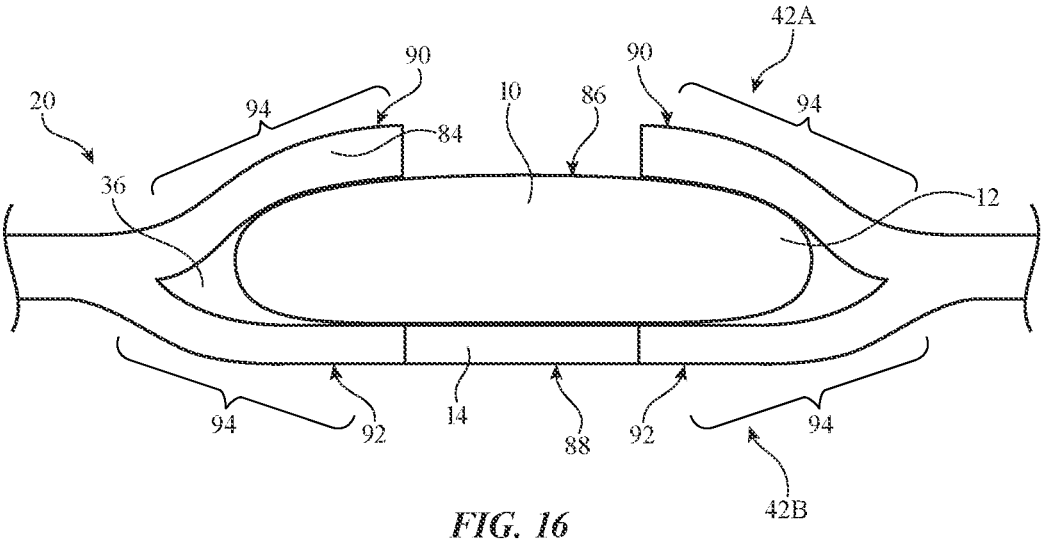
FIG. 16 is a cross-sectional side view of an illustrative case holding an electronic device in accordance with an embodiment.

FIG. 16 is a cross-sectional side view of an illustrative device that has been inserted into case 20. As shown in FIG. 16, case 20 may have debossed regions such as debossed regions 94 that are shaped to extend up and over the top and bottom surfaces of device 10. Debossed regions 94 may extend around the periphery of device 10. As shown in FIG. 16, upper portion 42A may have an upper surface 90 that is raised relative to upper surface 86 of device 10, whereas lower portion 42B may have a lower surface 92 that is flush with lower surface 88 of device 10 (e.g., a lower surface formed by battery door 14). This is, however, merely illustrative. If desired, upper surface 90 of upper portion 42A may be flush with upper surface 86 of device 10, and lower surface 92 of lower portion 42B may be raised with respect to lower surface 88 of device 10 (e.g., a lower surface formed by battery door 14). Arrangements in which both sides of case 20 are flush with device 10 or where both sides of case 20 are raised relative to device 10 may also be used. The configuration of FIG. 16 is merely illustrative.

The foregoing is merely illustrative and various modifications can be made by those skilled in the art without departing from the scope and spirit of the described embodiments. The foregoing embodiments may be implemented individually or in any combination.

What is claimed is:

1. A case for holding a tracking device having an upper surface and a lower surface, the case comprising:

a first polymer layer that forms an upper portion and a lower portion of a pocket for receiving the tracking device;

a second polymer layer having a first portion that overlaps the upper portion of the pocket and a second portion that overlaps the lower portion of the pocket;

a first opening on a first side of the pocket that exposes the upper surface of the tracking device; and a second opening on a second side of the pocket that exposes the lower surface of the tracking device.

2. The case of claim 1, wherein the case is flush with the lower surface of the tracking device and is raised with respect to the upper surface of the tracking device.

3. The case of claim 1, further comprising a filler material interposed between the first polymer layer and the second polymer layer at each of the upper portion and the lower portion of the pocket.

4. The case of claim 1, wherein the first polymer layer and the second polymer layer each comprise molded polyurethane.

5. The case of claim 1, further comprising a snap that is configured to open and close the pocket.

6. The case defined in claim 5, further comprising reinforcement material that surrounds the first opening, the second opening, and the snap.

7. A case for holding a tracking device having an upper surface and a lower surface, the case comprising:

a polymer layer molded as a single structure to form:

an upper portion of a pocket for receiving the tracking device, the upper portion defining a first opening on a first side of the pocket that exposes the upper surface of the tracking device;

a lower portion of the pocket overlapping the upper portion, the lower portion defining a second opening on a second side of the pocket that exposes the lower surface of the tracking device, wherein the polymer layer is molded into a U-shape at a joint region that is on an end of the case;

a first attachment portion extending from the upper portion; and a second attachment portion extending from the lower portion and overlapping the first attachment portion, wherein the joint region is on the end of the case opposite the first attachment portion and the second attachment portion.

8. The case of claim 7, further comprising a snap configured to secure the first attachment portion to the second attachment portion by extending through a first snap opening and a second snap opening.

9. The case of claim 7, wherein:

the polymer layer is a first polymer layer; and the case further comprises a second polymer layer having a first portion that overlaps the upper portion of the pocket and a second portion that overlaps the lower portion of the pocket.

10. The case of claim 9, further comprising a filler material interposed between the first polymer layer and the second polymer layer at each of the upper portion and the lower portion of the pocket.

11. The case of claim 7, wherein the polymer layer comprises molded polyurethane.

12. A case for holding a tracking device having an upper surface and a lower surface, the case comprising:

a polymer layer molded as a single structure to form:

an upper portion of a pocket for receiving the tracking device;

a lower portion of the pocket overlapping the upper portion;

a first attachment portion extending from the upper portion and defining a first snap opening;

a second attachment portion extending from the lower portion, overlapping the first attachment portion, and defining a second snap opening;

a first pocket opening on a first side of the pocket that exposes the upper surface of the tracking device; and a second pocket opening on a second side of the pocket that exposes the lower surface of the tracking device; and a snap configured to secure the first attachment portion to the second attachment portion by extending through the first snap opening and the second snap opening.

13. The case of claim 12, wherein the upper portion and the lower portion are molded into a U-shape at a joint region that is on an end of the case that is opposite the first attachment portion and the second attachment portion.

14. The case of claim 12, wherein:

the polymer layer is a first polymer layer; and the case further comprises a second polymer layer having a first portion that overlaps the upper portion of the pocket and a second portion that overlaps the lower portion of the pocket.

15. The case of claim 14, further comprising a filler material interposed between the first polymer layer and the second polymer layer at each of the upper portion and the lower portion of the pocket.

16. The case defined in claim 12, further comprising reinforcement material that surrounds the first pocket opening, the second pocket opening, the first snap opening, and the second snap opening.

17. The case defined in claim 16, wherein the reinforcement material comprises woven strands of non-elastic material.

18. The case of claim 12, wherein the polymer layer comprises molded polyurethane.

19. A case for holding a tracking device having an upper surface and a lower surface, the case comprising:

a first polymer layer molded as a single structure to form:

an upper portion of a pocket for receiving the tracking device, the upper portion defining a first opening on a first side of the pocket that exposes the upper surface of the tracking device; and a lower portion of the pocket overlapping the upper portion, the lower portion defining a second opening on a second side of the pocket that exposes the lower surface of the tracking device, wherein the first polymer layer is molded into a U-shape at a joint region that is on an end of the case; and a second polymer layer having a first portion that overlaps the upper portion of the pocket and a second portion that overlaps the lower portion of the pocket.

20. The case of claim 19, further comprising a filler material interposed between the first polymer layer and the second polymer layer at each of the upper portion and the lower portion of the pocket.

* * * * *